US011808131B2

(12) United States Patent
Ba et al.

(10) Patent No.: US 11,808,131 B2
(45) Date of Patent: *Nov. 7, 2023

(54) DISPLAYING STEERING RESPONSE WITH UNCERTAINTY IN A HEAT MAP ELLIPSE

(71) Applicant: Schlumberger Technology Corporation, Sugar Land, TX (US)

(72) Inventors: Samba Ba, Beijing (CN); Conie Chiock, Katy, TX (US); Ginger Hildebrand, Houston, TX (US); Maurice Ringer, London (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/812,204

(22) Filed: Jul. 13, 2022

(65) Prior Publication Data

US 2022/0341308 A1 Oct. 27, 2022

Related U.S. Application Data

(63) Continuation of application No. 16/569,576, filed on Sep. 12, 2019, now Pat. No. 11,396,801.

(51) Int. Cl.

| | |
|---|---|
| ***E21B 44/00*** | (2006.01) |
| ***E21B 7/04*** | (2006.01) |
| ***E21B 47/024*** | (2006.01) |
| ***E21B 41/00*** | (2006.01) |
| *E21B 49/00* | (2006.01) |

(52) U.S. Cl.

CPC ..... *E21B 44/00* (2013.01); *E21B 7/04* (2013.01); *E21B 41/00* (2013.01); *E21B 47/024* (2013.01); *E21B 49/00* (2013.01)

(58) Field of Classification Search

CPC ..... E21B 44/00; E21B 7/04; E21B 47/024; E21B 49/00; E21B 15/04; E21B 41/0092; E21B 41/00

See application file for complete search history.

(56) References Cited

U.S. PATENT DOCUMENTS

| | | | |
|---|---|---|---|
| 7,802,634 | B2 | 9/2010 | Boone |
| 8,510,081 | B2 | 8/2013 | Boone et al. |
| 8,528,663 | B2 | 9/2013 | Boone |

(Continued)

OTHER PUBLICATIONS

International Search Report and Written Opinion of International Patent Application No. PCT/US2020/070508 dated Dec. 11, 2020, 12 pages.

(Continued)

*Primary Examiner* — Robert E Fuller

(74) *Attorney, Agent, or Firm* — Aashish Y. Chawla

(57) ABSTRACT

A computer-implemented method including receiving a steering command identifying a tool face orientation in which the steering command is expected to produce an intended steering response of an intended drilling trajectory. The method further includes receiving an actual steering response result of the steering command in which the actual steering response result identifies an actual drilling trajectory. The method further includes storing a dataset comparing the actual steering response result in relation to the intended steering response, determining an uncertainty level of the tool face orientation based on the stored dataset, and outputting a visual representation of steering response with the uncertainty level.

20 Claims, 9 Drawing Sheets

(56) References Cited

U.S. PATENT DOCUMENTS

| | | | |
|---|---|---|---|
| 10,672,154 | B2 | 6/2020 | Gillen et al. |
| 10,781,684 | B2 | 9/2020 | Wagner et al. |
| 11,396,801 | B2 | 7/2022 | Ba et al. |
| 2009/0000823 | A1 | 1/2009 | Pirovolou |
| 2009/0120690 | A1 | 5/2009 | Phillips |
| 2009/0152005 | A1 | 6/2009 | Chapman et al. |
| 2012/0048618 | A1 | 3/2012 | Zamanian et al. |
| 2016/0102544 | A1 | 4/2016 | Aklestad et al. |
| 2016/0265336 | A1 | 9/2016 | Benson et al. |
| 2016/0312598 | A1 | 10/2016 | Samuel et al. |
| 2017/0058656 | A1 | 3/2017 | Benson et al. |
| 2017/0243383 | A1 | 8/2017 | Gillan et al. |
| 2019/0284908 | A1 | 9/2019 | Dykstra et al. |

OTHER PUBLICATIONS

Nasir, E. et al., "Optimizing Drilling Parameters Using a Random Forests ROP Model in the Permian Basin", SPE-191796-MS presented at the SPE Liquids-Rich Basin Conference—North America, held in Midland, Texas, 2018, 13 pages.

Extended Search Report issued in European Patent Application No. 20862878.4 dated Aug. 8, 2023, 7 pages.

DISPLAYING STEERING RESPONSE WITH UNCERTAINTY IN A HEAT MAP ELLIPSE

CROSS-REFERENCE TO RELATED CASES

This application is a continuation of pending application Ser. No. 16/569,576 filed on 12 Sep. 2019, the disclosure of which is incorporated herein by reference.

BACKGROUND

In a directional drilling project (e.g., for drilling a wellbore), the orientation (e.g., "tool face") of drilling equipment is periodically adjusted in order to drill a hole with a subterranean path along a planned trajectory. The planned trajectory may be relatively straight and vertical at an initial portion, but may curve and gradually straighten horizontally at lower depths. The trajectory may be planned and designed to account for various subterranean attributes, obstructions, etc., and to maximize oil and gas recovery.

SUMMARY

Embodiments of the disclosure may provide a computer-implemented method including receiving a steering command identifying a tool face orientation in which the steering command is expected to produce an intended steering response of an intended drilling trajectory. The method further includes receiving an actual steering response result of the steering command in which the actual steering response result identifies an actual drilling trajectory. The method further includes storing a dataset comparing the actual steering response result in relation to the intended steering response, determining an uncertainty level of the tool face orientation based on the stored dataset, and outputting a visual representation of steering response with the uncertainty level.

Embodiments of the disclosure may also provide a computing system including one or more processors, and a memory system comprising one or more non-transitory computer-readable media storing instructions that, when executed by at least one of the one or more processors, cause the computing system to perform operations. The operations may include receiving a drilling trajectory plan identifying a planned drilling trajectory, determining a tool face orientation for drilling along a portion of the planned drilling trajectory by drilling equipment, identifying an uncertainty level associated with the tool face orientation based on steering response uncertainty data stored in a repository, determining a drilling plan for drilling along the portion based on the uncertainty level, and outputting the drilling plan for executing the drilling plan by the drilling equipment.

Embodiments of the disclosure may further provide a non-transitory computer-readable medium storing instructions that, when executed by one or more processors of a computing system, cause the computing system to perform operations. The operations may include determining a respective plurality of uncertainty levels of respective tool face orientations based on deviations between expected drilling trajectories and actual drilling trajectories, storing the respective plurality of uncertainty levels in a repository, and outputting a visual representation of the respective plurality of uncertainty levels.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
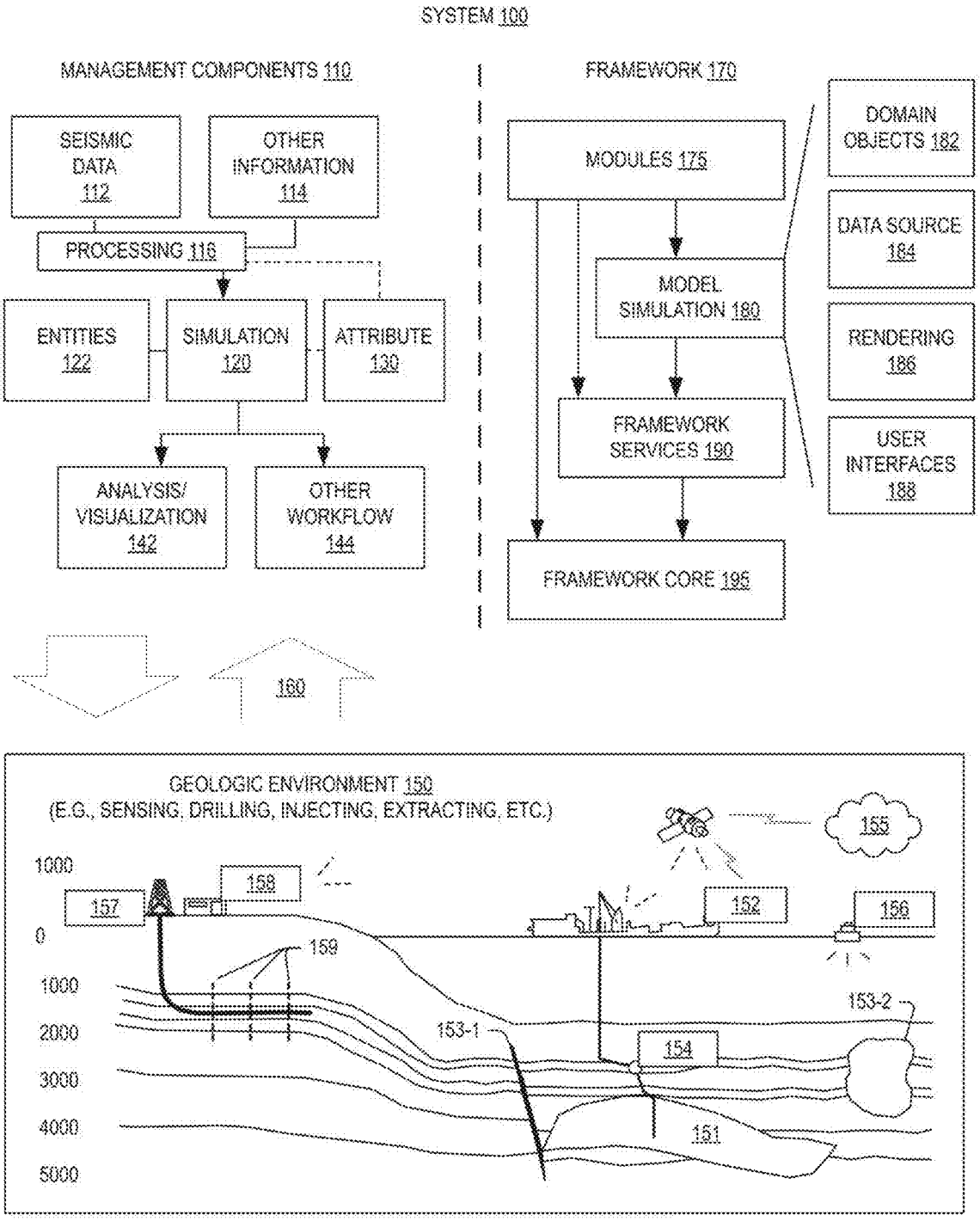
FIG. 1 illustrates an example of a system that includes various management components to manage various aspects of a geologic environment, according to an embodiment.

Effective directional drilling involves adjusting the tool face and/or other operating parameters of drilling equipment such that the actual drilling trajectory of a hole (e.g., a wellbore) matches a planned trajectory. However, due to various geological factors, the actual trajectory may not follow the intended trajectory. Accordingly, aspects of the present disclosure may track various data points and analytics data to determine the steering response and the uncertainty of drilling equipment trajectory at different tool face orientations and/or based on other conditions. As described herein, the "uncertainty" may refer to a quantitative measurement, confidence, or likelihood to which an actual drilled trajectory matches an intended or expected trajectory based at least in part on the tool face direction. In some embodiments, the uncertainty may be based on the number data points that track the steering response at a particular tool face orientation, and the consistency of the results between actual and intended steering responses. For example, if a substantial number of data points (e.g., greater than a threshold number) have been gathered when the tool face orientation is set to a particular orientation (e.g., 10 degrees), and the actual versus intended steering responses have a consistently low deviation (e.g., below a threshold level), the uncertainty value may be relatively low, indicating that the steering response has a low degree of uncertainty (i.e., high degree of certainty) when the tool face orientation is set to the particular orientation.

Information regarding the steering response and uncertainty may be presented to drilling operators and planners to aid in planning a directional drilling project, and/or adjust drilling equipment parameters in real time to enable correction or reduction of a deviation between the actual drilling trajectory and the planned trajectory. Examples of drilling equipment parameters that may be planned and/or adjusted may include equipment drilling speed, torque, power, tool face or drilling direction, and/or any other variety of parameters and/or operations for drilling. In general, when uncertainty is relatively lower, equipment may be set to drill at higher speeds and torque, with less frequent trajectory checks, as it is less likely that these higher speeds and torque will cause the actual drilling trajectory to deviate from the planned trajectory. Similarly, when uncertainty is relatively higher, equipment may be set to drill at lower speeds and torque, with more frequent trajectory checks, as it is more likely that the actual drilling trajectory may deviate from the planned trajectory.

As described herein, the presentation of steering response uncertainty data may be presented in a format that is easy to view, synthesize, understand, and apply for improving the effectiveness and accuracy of a drilling operation, with respect to the actual drilling trajectory versus the planned drilling trajectory. In some embodiments, aspects of the present disclosure may combine a heat map and an ellipse to graphically present the steering response and the uncertainties in a single view, thereby allowing a user to visualize the uncertainty of steering response at different tool face orientations. As an example, an ellipse graph may display a steering response ellipse with the uncertainty being based on the tool face orientation and a turn rate as a function of build rate. Using the graphical presentation, operators and/or drilling planners may better visualize uncertainty and make more intelligent and effective decisions for planning directional drilling projects in advance, and for adjusting drilling plans and operations in real time. Additionally, or alternatively, computer-based equipment control devices may automatically adjust equipment operations using the steering response and uncertainty data.

As an illustrative example, aspects of the present disclosure may determine and graphically present information indicating that the steering response uncertainty is relatively low at a certain tool face direction, meaning that the steering response is relatively predictable and drilling equipment is likely to follow and intended trajectory. Based on a low uncertainty, drilling equipment may be set to run at relatively higher speeds, higher torque, with fewer adjustment checks. Other drilling operating parameters may be adjusted accordingly. Similarly, when the steering response is relatively high, meaning that the steering response may be unpredictable, drilling equipment may be set to run at lower speeds, with lower torque, and additional adjustment checks.

As described herein, a planned or intended drilling trajectory for a directional drilling project may be relatively straight and vertical at an initial portion, but may curve and gradually straighten horizontally at lower depths. The planned trajectory may be divided into sections, and the steering response uncertainty at each section may be determined (e.g., based on the trajectory for that section and corresponding tool face direction for drilling along the section's trajectory). Based on the uncertainty, the operating parameters of each section may be planned. Also, the drilling trajectory may be tracked in real time against the planned trajectory for each section. If the actual trajectory deviates from the planned trajectory more than a threshold degree within a section, adjustments may be made using the uncertainty data to redirect the drilling equipment back towards the planned trajectory. In some embodiments, operators and/or directional drilling planners may use the graphic presentation of the steering response and uncertainty to plan a directional drilling project in advance, or to make real-time adjustments during a live directional drilling project. Additionally, or alternatively, computer-based equipment control devices may automatically adjust equipment operations using the steering response and uncertainty data.

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116, a simulation component 120, an attribute component 130, an analysis/visualization component 142 and a workflow component 144. In operation, seismic data and other information provided per the components 112 and 114 may be input to the simulation component 120.

In an example embodiment, the simulation component 120 may rely on entities 122. Entities 122 may include earth entities or geological objects such as wells, surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT® .NET® framework (Redmond, Wash.), which provides a set of extensible object classes. In the .NET® framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (Schlumberger Limited, Houston Tex.), the INTERSECT™ reservoir simulator (Schlumberger Limited, Houston Tex.), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (Schlumberger Limited, Houston, Tex.). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (Schlumberger Limited, Houston, Tex.) allows for integration of add-ons (or plug-ins) into a PETREL® framework workflow. The OCEAN® framework environment leverages .NET® tools (Microsoft Corporation, Redmond, Wash.) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Figure 2:
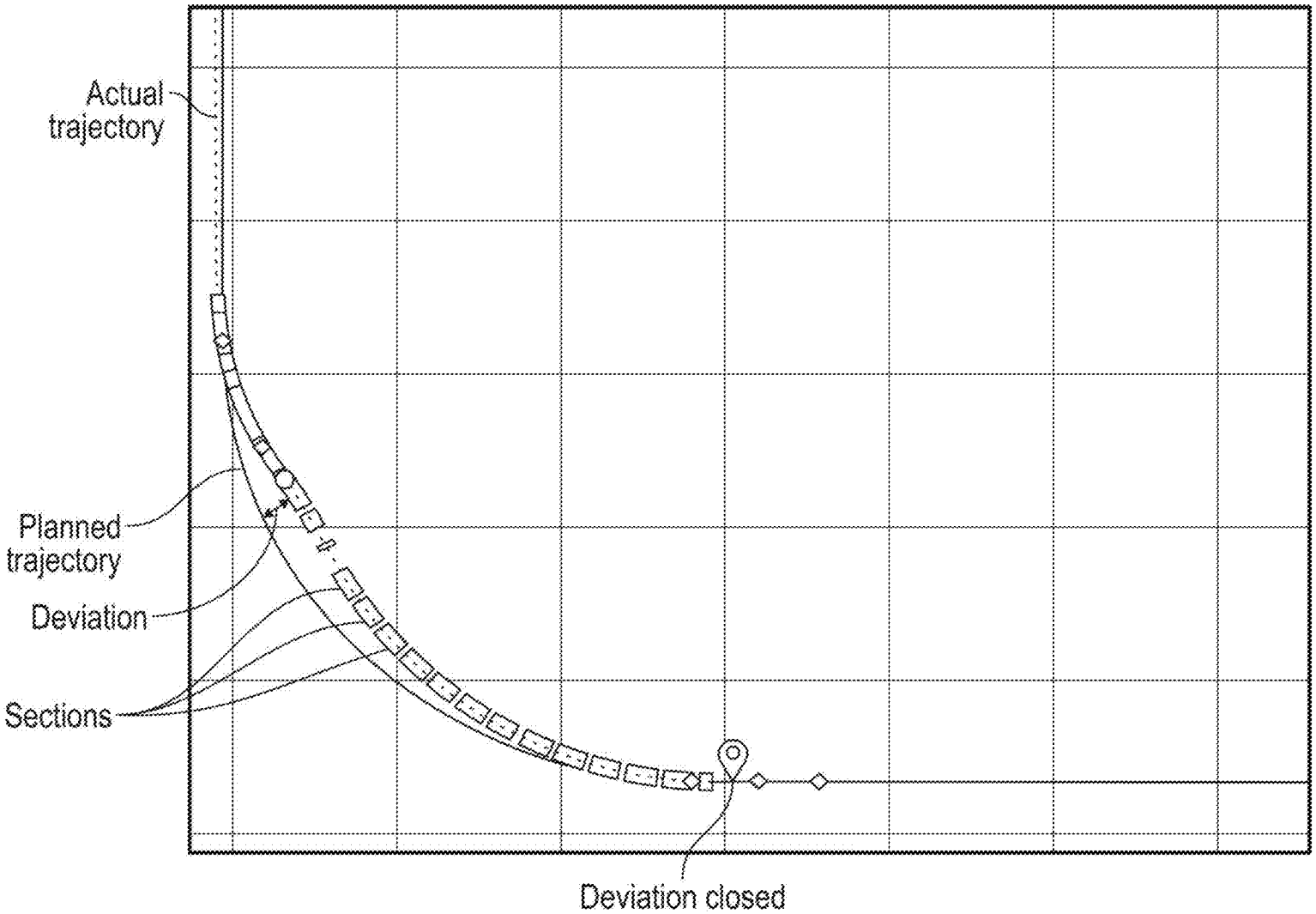
FIG. 2 illustrates an example interface showing a planned drilling trajectory in relation to an actual drilling trajectory, according to an embodiment.

FIG. 2 illustrates an example interface 200 showing a planned drilling trajectory in relation to an actual drilling trajectory. As shown in FIG. 2, the planned trajectory may be relatively straight and vertical at an initial (e.g., shallower) portion, but may curve and gradually straighten horizontally at greater depths. During the course of drilling, the actual drilling trajectory may deviate from the planned trajectory. Accordingly, aspects of the present disclosure may minimize the deviation by adjusting the drilling operations with consideration to tool face uncertainty. In some embodiments, the planned trajectory may be divided into sections, and a drilling plan may be determined for each section. The tool face orientation that should be set in order to drill in the intended trajectory for a section may be determined, and the uncertainty associated with the tool face orientation may be identified. Based on the uncertainty level, a drilling plan for the section may be determined. As described herein, the drilling plan may identify an equipment operating speed, operating torque level, build rate, turn rate, trajectory monitoring rates, etc. As an illustrative example, for a tool face orientation having relatively low uncertainty value, the operating speed, operating torque level, build rate, and/or turn rate may be relatively higher than for a tool face orientation having a relatively high uncertainty value. As drilling progresses, the actual trajectory may be monitored and adjustments are made to the drilling plan with consideration to the uncertainty. Further, steering response with uncertainty data may be presented in the form of an ellipse (e.g., a heatmap ellipse), providing operators and planners with a rich set of data to aid in planning a drilling project in advance or making adjustments in real-time.

Figure 3:
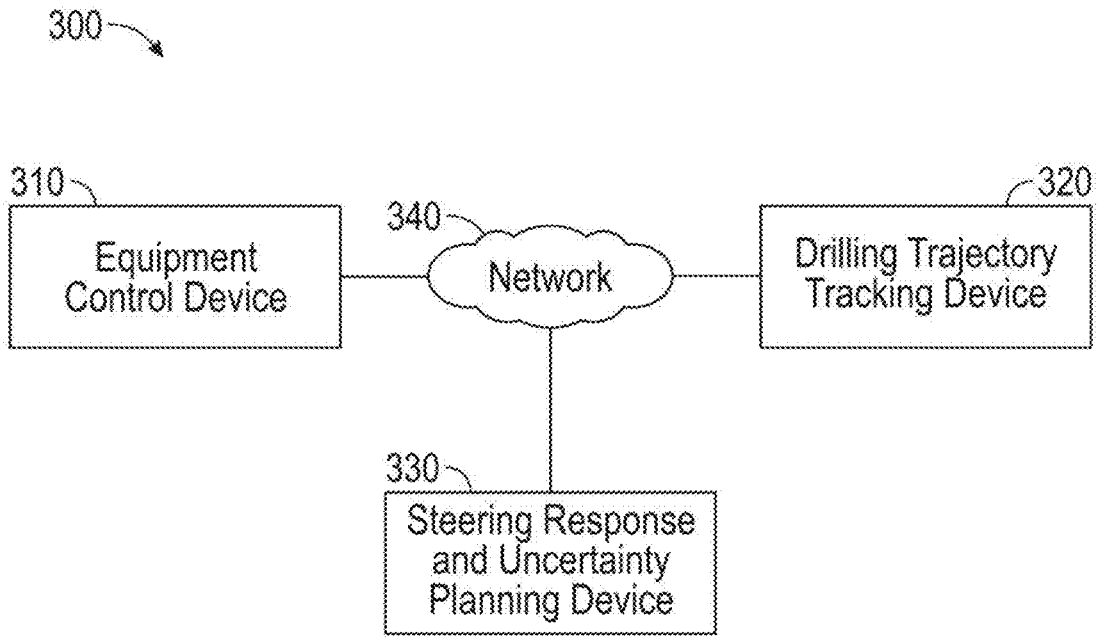
FIG. 3 shows an example drilling control environment according to an embodiment.

FIG. 3 shows an example environment in accordance with aspects of the present disclosure. As shown in FIG. 3, environment 300 may include an equipment control device 310, a drilling trajectory tracking device 320, a steering response and uncertainty planning device 330, and a network 340.

The equipment control device 310 may include one or more computing devices that control the operations of drilling equipment involved in a directional drilling project. For example, the equipment control device 310 may receive commands to control various drilling equipment operations, such as equipment speed, torque, build rate, turn rate, etc. In some embodiments, the equipment control device 310 may receive automated commands from the steering response and uncertainty planning device 330 and/or user input commands from an operator.

The drilling trajectory tracking device 320 may include one or more sensors, accelerometers, magnetometers, and/or data acquisition devices that gathers data relating to drilling trajectory. In some embodiments, the drilling trajectory tracking device 320 may be a component in a measurement while drilling (MWD) system. In some embodiments, the drilling trajectory tracking device 320 may gather and report the trajectory data to the steering response and uncertainty planning device 330 at periodic intervals defined by a drilling plan.

The steering response and uncertainty planning device 330 may include one or more computing devices that determines the steering responses of drilling equipment based on different tool face directions, and further determines the uncertainty of the responses at the different tool face directions. In some embodiments, the steering response and uncertainty planning device 330 may determine the steering responses and uncertainty by collecting steering response data from real-time drilling operations over a period of time and/or from collecting data from drilling operations in a test or controlled environment. The steering response and uncertainty planning device 330 may present the steering response and uncertainty data in the form of an ellipse and/or a combined heatmap and ellipse, which may be used by drilling planners and/or operators to plan/adjust drilling operations in advance and/or in real-time. In some embodiments, the steering response and uncertainty planning device 330 may determine or adjust a drilling plan automatically based on the steering response and uncertainty data. In some embodiments, the drilling trajectory tracking device 320 and/or the steering response and uncertainty planning device 330 may be implemented in one or more applications to aid in tracking and/or drill planning.

The network 340 may include network nodes, such as network nodes 10 of FIG. 3. Additionally, or alternatively, the network 340 may include one or more wired and/or wireless networks. For example, the network 340 may include a cellular network (e.g., a second generation (3G) network, a third generation (3G) network, a fourth generation (4G) network, a fifth generation (3G) network, a long-term evolution (LTE) network, a global system for mobile (GSM) network, a code division multiple access (CDMA) network, an evolution-data optimized (EVDO) network, or the like), a public land mobile network (PLMN), and/or another network. Additionally, or alternatively, the network 340 may include a local area network (LAN), a wide area network (WAN), a metropolitan network (MAN), the Public Switched Telephone Network (PSTN), an ad hoc network, a managed Internet Protocol (IP) network, a virtual private network (VPN), an intranet, the Internet, a fiber optic-based network, and/or a combination of these or other types of networks. In embodiments, the network 340 may include copper transmission cables, optical transmission fibers, wireless transmission, routers, firewalls, switches, gateway computers and/or edge servers.

Figure 4:
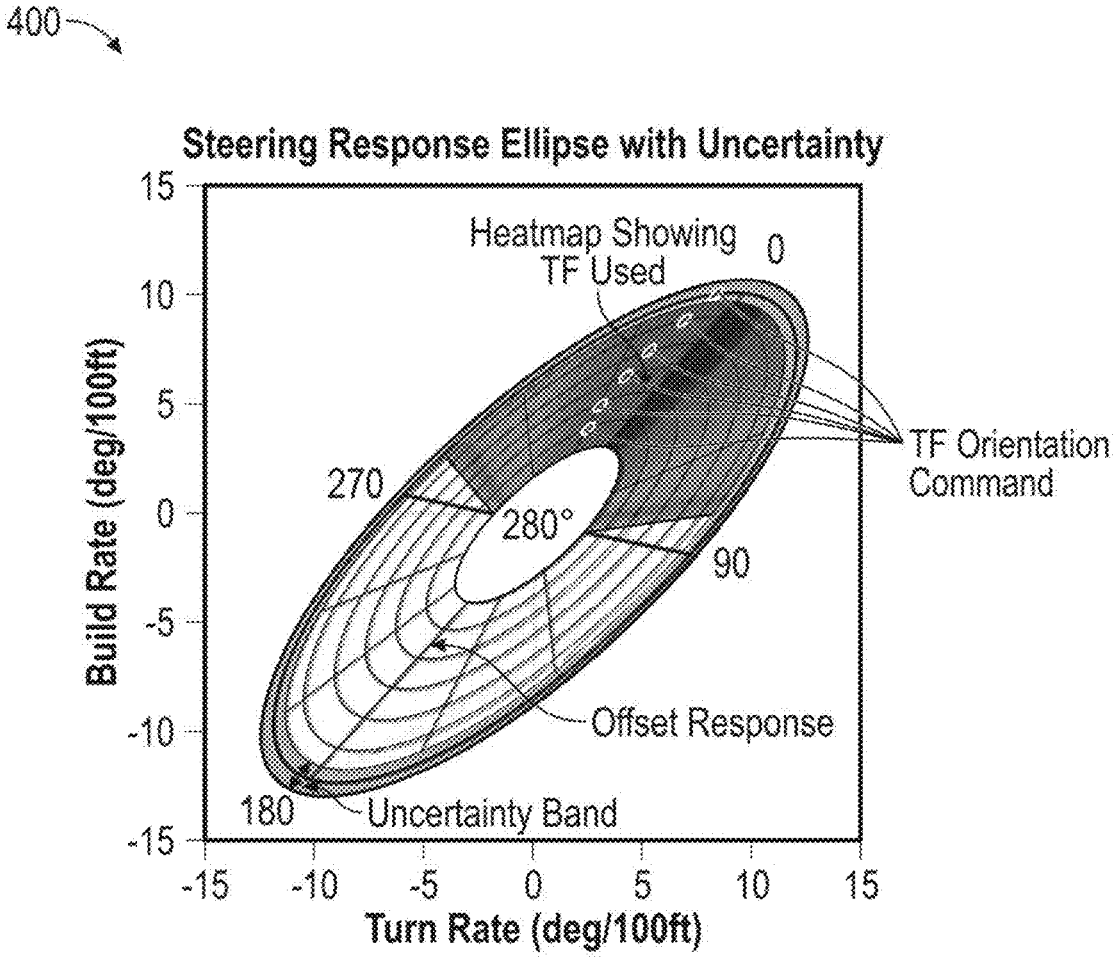
FIG. 4 illustrates an example steering response ellipse with uncertainty data represented in a heatmap, according to an embodiment.

FIG. 4 illustrates an example steering response ellipse with uncertainty data represented in a heatmap. As shown in FIG. 4, the ellipse 400 may identify a heatmap showing a tool face (TF) used (e.g., based on actual TF orientation commands received by the equipment control device 310). As described herein, the TF orientation commands may correspond to an intended drilling trajectory. The heatmap may include different colors and/or shades that represent the level of uncertainty at a particular tool face orientation, build rate, and turn rate. In some embodiments, darker shades or a red color may represent a lower level of uncertainty, although any variations between shades and colors are possible for representing different levels of uncertainty. In one illustrative example, the uncertainty level may be relatively low at tool face orientations of 0°, at build and turn rates from 0°/100 feet, to 15°/100 feet.

In some embodiments, the ellipse 400 may identify an uncertainty band and an offset response. The uncertainty band may represent a range of uncertainty for a given tool face direction, and the offset response may identify an actual drilling trajectory in relation to a tool face direction. For example, a tool face orientation of 10 degrees may have a one-degree offset, such that the trajectory is nine degrees. The example ellipse 400 may illustrate the steering response for a particular type of equipment, such as mud motors. In some embodiments, the display of the ellipse 400 may be selectable between Measured Depth or True Vertical Depth. Using the ellipse 400, an operator or planner may easily visualize the uncertainty of drilling trajectory based on the tool face orientation.

Figure 5:
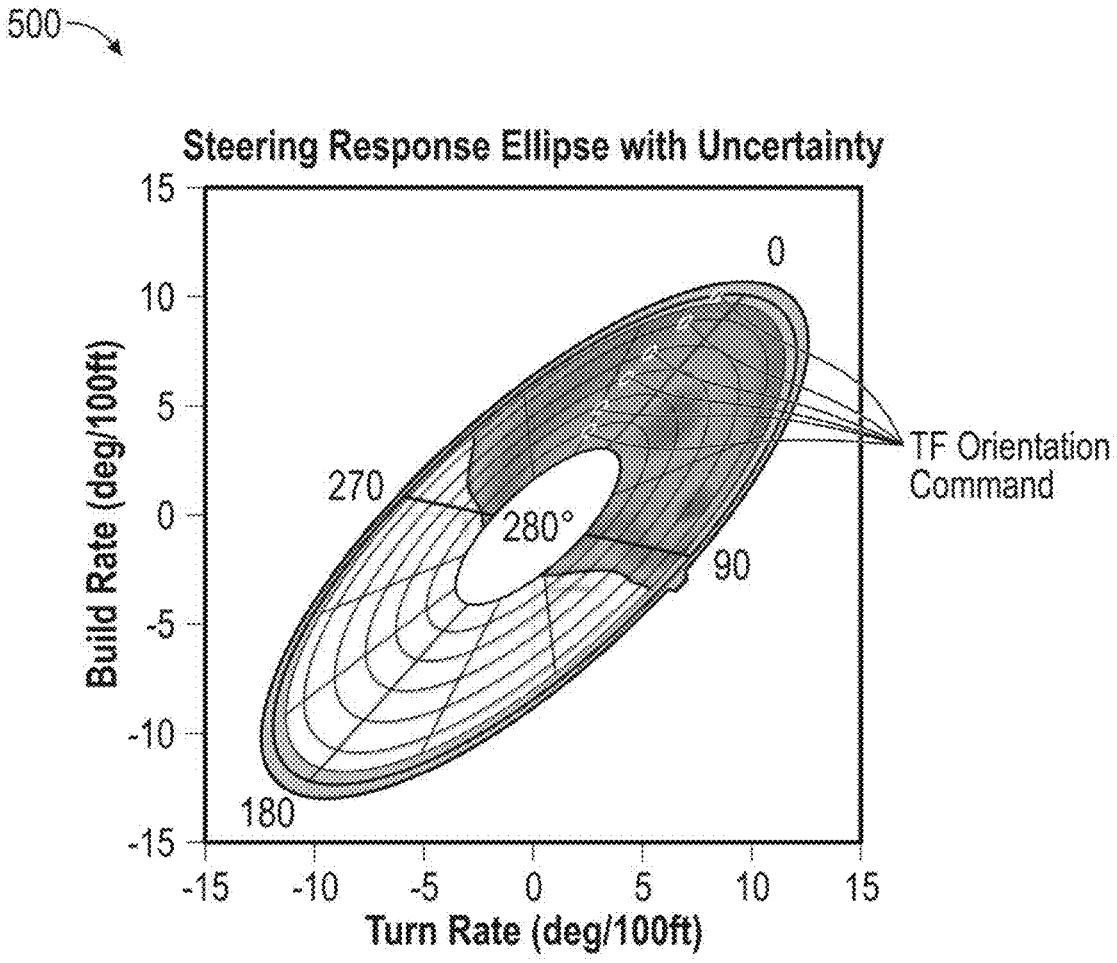
FIG. 5 illustrates another example of a steering response ellipse with uncertainty data represented in a heatmap, according to an embodiment.

FIG. 5 illustrates another example of a steering response ellipse with uncertainty data represented in a heatmap. The example ellipse 500 may illustrate the steering response for a particular type of equipment, such as a rotary steerable system (RSS). The ellipse 500 may have a similar format to that of ellipse 400 in FIG. 4, and may display the different uncertainty levels for the RSS equipment operating at different tool face directions, build rates, and turn rates.

Figure 6:
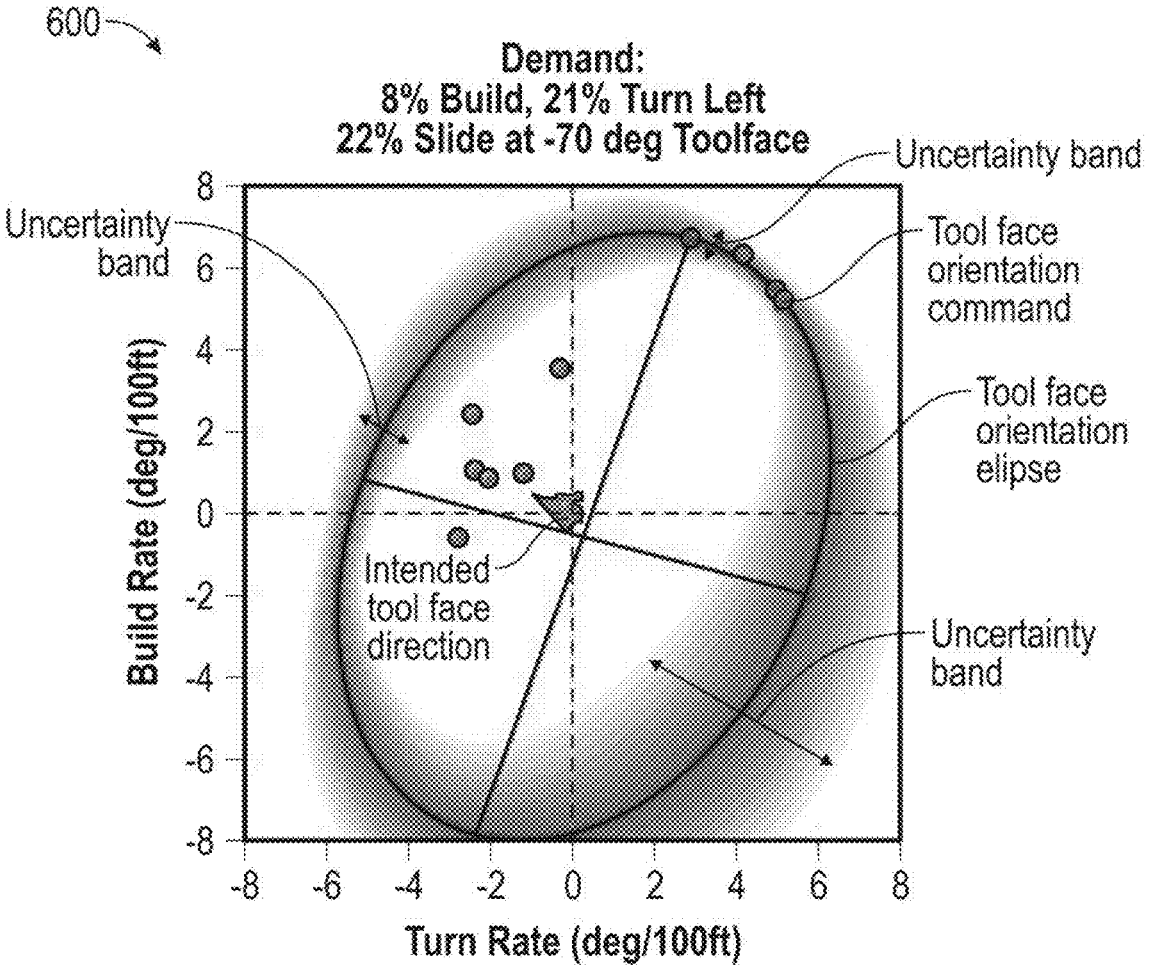
FIG. 6 illustrates an example steering response ellipse with varying uncertainty bands, according to an embodiment.

FIG. 6 illustrates an example steering response ellipse with varying uncertainty bands. More specifically, the ellipse 600 illustrates a steering response of equipment operating under a particular set of demand conditions, as shown. In some embodiments, the tool face orientation commands (e.g., received by the equipment control device 310) may be plotted along the ellipse 600. Further, the intended tool face direction may also be shown. A level of uncertainty at different tool face orientations is shown by shadings around the tool face orientation ellipse. As shown in FIG. 6, the uncertainty band (e.g., the range of uncertainty levels) may vary across the tool face orientation ellipse. In some embodiments, the uncertainty band may be wider at orientations in which fewer data points exist (e.g., data points corresponding to the tool face orientation commands). For example, the greater the number of data points, the narrower the uncertainty band. Further, the greater number of data points with consistent results (e.g., consistent actual vs. intended trajectory results), the narrower the uncertainty band. In this way, the ellipse 600 may be used to visualize the uncertainty at different tool face orientations and under a set of demand conditions.

Figure 7:
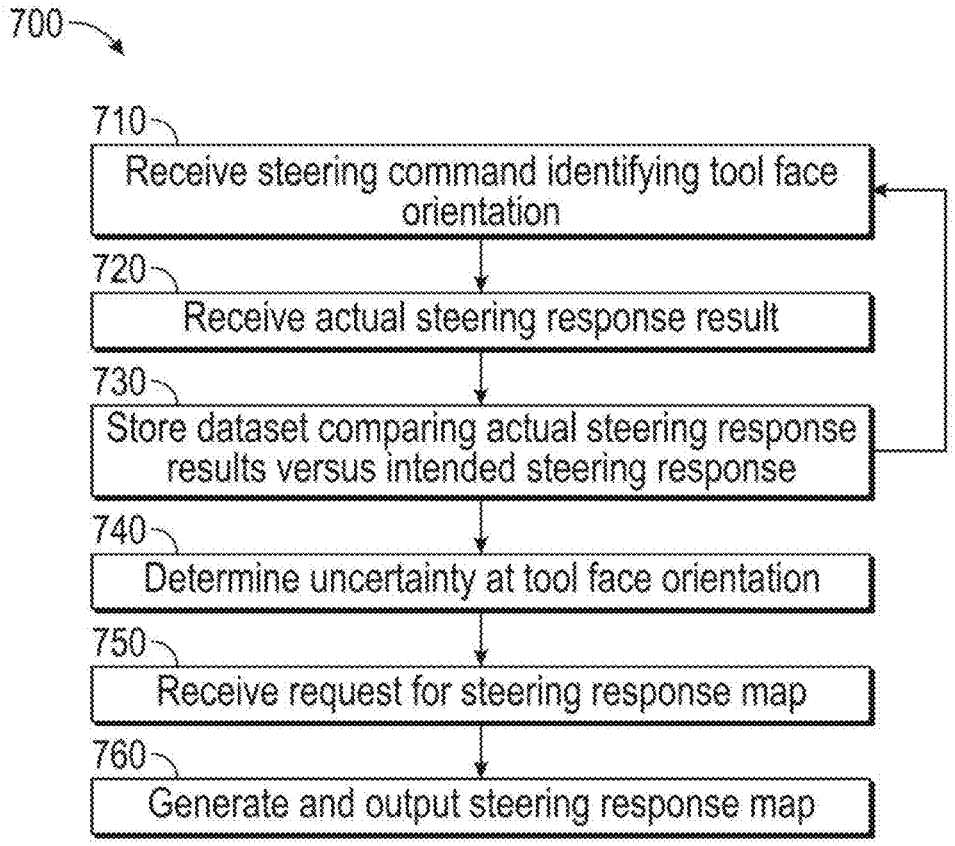
FIG. 7 illustrates an example flowchart of a process for generating, updating, and presenting a steering response map to be used in the advance and/or real-time planning of drilling operations for a directional drilling project, according to an embodiment.

FIG. 7 illustrates an example flowchart of a process for generating, updating, and presenting a steering response map to be used in the advance and/or real-time planning of drilling operations for a directional drilling project. The steps of FIG. 7 may be implemented in the environment of FIG. 3, for example, and are described using reference numbers of elements depicted in FIG. 3. The flowchart illustrates the architecture, functionality, and operation of possible implementations of systems, methods, and computer program products according to various embodiments of the present disclosure.

As shown in FIG. 7, process 700 may include receiving a steering command identifying a tool face orientation (block 710). For example, the steering response and uncertainty planning device 330 may receive, from the equipment control device 310, a steering command identifying a tool face orientation (e.g., a steering angle or tool face angle). In some embodiments, the steering command may be received by the equipment control device 310 from an operator and/or via an automated system to control the tool face orientation as part of a directional drilling project (e.g., to drill a hole along a planned trajectory based on the tool face). The steering command may be based on an intended steering response. The intended steering response may refer to an intended drilling angle and/or intended drilling trajectory based on the tool face orientation. In some embodiments, the intended steering response may match the tool face orientation, or may differ from the tool face orientation. For example, a tool face orientation of 10 degrees may have a one-degree offset, such that the intended steering response when the tool face orientation is set to 10 degrees is a drilling angle/trajectory of nine degrees. In some embodiments, the steering command may identify other parameters in addition to the tool face orientation, such as build rate and turn rate.

The process 700 may include receiving an actual steering response result (block 720). For example, the steering response and uncertainty planning device 330 may receive information identifying an actual steering response result from the drilling trajectory tracking device 320. In some embodiments, the actual steering response result may identify the angle of a hole drilled by the equipment and/or the trajectory of the hole drilled.

The process 700 may include storing a dataset comparing the actual steering response verses the intended steering response (block 730). For example, the steering response and uncertainty planning device 330 may store information comparing the actual steering response verses the intended steering response at the tool face orientation (e.g., the actual drilled trajectory or angle and the intended drilled trajectory or angle). In some embodiments, the information may be stored in a data structure. The information comparing the actual steering response verses the intended steering response may identify a level of deviation between the actual and intended responses. In some embodiments, the dataset may be timestamped, and may include additional metadata, such as geographic location in which the drilling occurred, equipment operating parameters at the time of drilling, type of equipment used for drilling, type of drilling project, type of drilling application, etc.

As shown in FIG. 7, the process 700 may return to block 710 and blocks 710-730 may be repeated. After each iteration of performing blocks 710-730, an additional dataset may be stored in which the dataset may include information comparing actual vs intended steering responses at a given tool face orientation/angle, build rate, and/or turn rate. Blocks 710-730 may be performed repeatedly over numerous iterations. In this way, multiple different datasets may be stored in which each dataset includes information comparing actual vs intended steering responses at a different tool face orientations, build rates, and turn rates. In some embodiments, blocks 710-730 may be implemented in a real-life drilling operation in which the actual versus intended steering response datasets are stored. Additionally, or alternatively, blocks 710-730 may be implemented in a controlled or test environment.

The process 700 may further include determining an uncertainty at a tool face orientation (block 740). For example, the steering response and uncertainty planning device 330 may determine an uncertainty value at a given tool face orientation based on the datasets comparing the actual steering response versus the intended steering response (e.g., datasets that were created after numerous iterations of performing process blocks 710-730). In some embodiments, the uncertainty may be based on the number datasets at a particular tool face orientation, and the consistency of the results between actual and intended steering responses. For example, if a substantial number of datasets (e.g., greater than a threshold number) have been analyzed at the tool face orientation of ten degrees, and the actual versus intended steering responses have a consistently low deviation (e.g., below a threshold level), the uncertainty value may be relatively low, indicating that the steering response has a low degree of uncertainty (i.e., high degree of certainty) when the tool face orientation is set to 10 degrees. As another illustrative example, if a relatively few number of datasets have been analyzed at the tool face direction of eighty degrees, and the actual versus intended steering responses have a consistently high deviation, the uncertainty value may be relatively high, indicating that the steering response has a high degree of uncertainty (i.e., low degree of certainty) when the tool face orientation is set to eighty degrees. Also, in addition to the uncertainty being determined at different tool face orientations, the uncertainty values may further be determined based on the build rate and/or turn rate. Additionally, or alternatively, the uncertainty may be determined based on additional variables, such as terrain properties, equipment type, equipment condition, etc. In some embodiments, block 740 may be repeated and the uncertainty at different tool face orientations, build rates, turn rates, etc. may be updated as additional datasets are generated in accordance with blocks 710-730. In some embodiments, uncertainty values at each tool face orientation may be stored in a data structure or repository.

The process 700 may also include receiving a request for a steering response map (block 750). For example, the steering response and uncertainty planning device 330 may receive a request for a steering response map. In some embodiments, the request may include one or more parameters identifying a subset of data from which the steering response map may be generated. Example parameters may include a timeframe in which drilling occurred, geographic locations in which drilling occurred, type of equipment, type of drilling application, etc.

The process 700 may further include generating and outputting the steering response map (block 760). For example, the steering response and uncertainty planning device 330 may generate and output the steering response map in the form of a heatmap ellipse in which the steering response map may be based on the parameters included in the request. As an illustrative example, the steering response map may present a subset of data gathered within a particular timeframe, or data associated with a particular geographic location, type of equipment, type of drilling application, etc. Additionally, or alternatively, the steering map may be presented in a defined window in Measured Depth or True Vertical Depth. As described herein, the steering response map may aid directional drilling planners and operators to better plan for a directional drilling project in advance, or adjust drilling operations in real-time to minimize a deviation between an actual drilling trajectory and a planned drilling trajectory.

Figure 8:
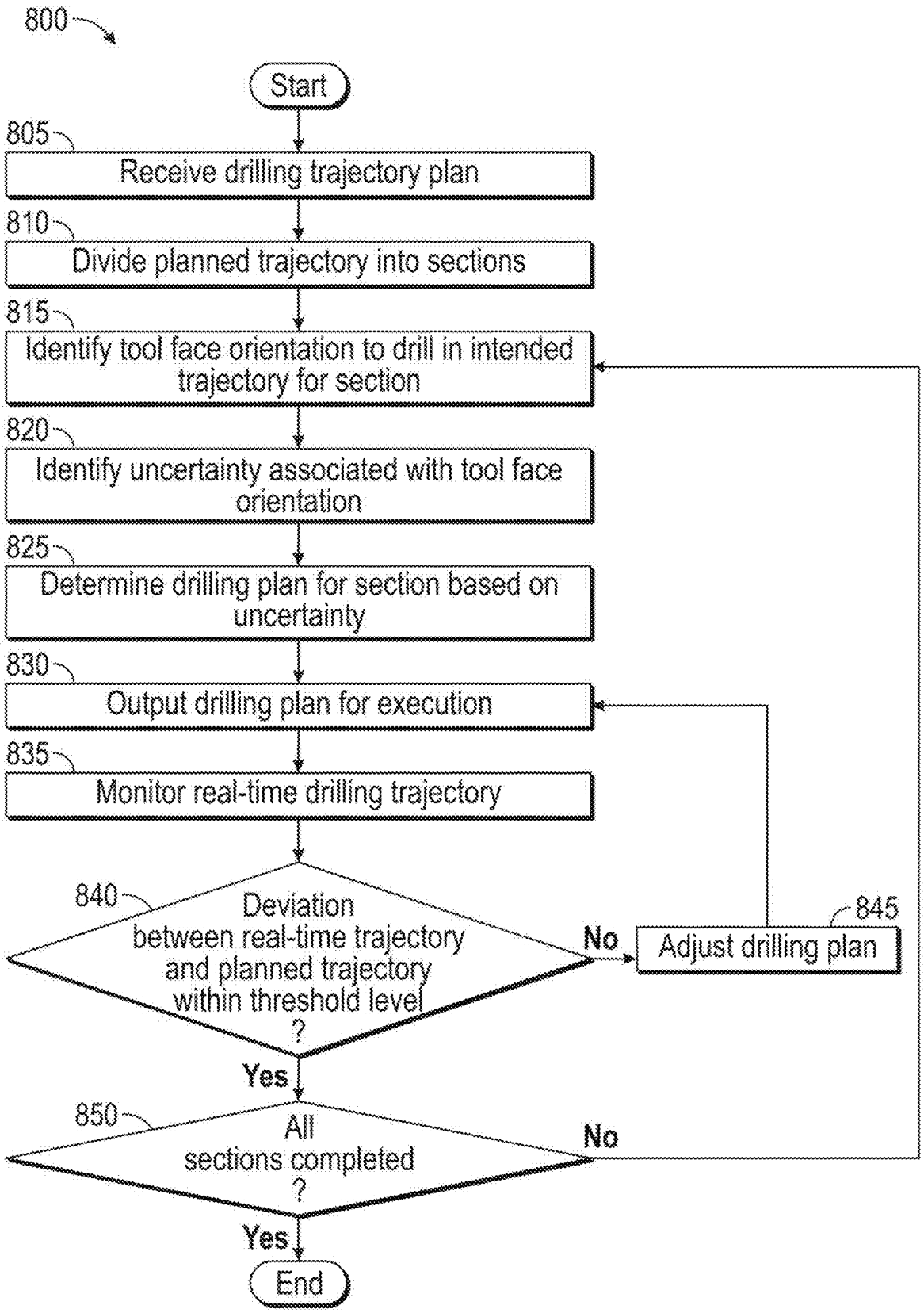
FIG. 8 illustrates an example flowchart of a process for using uncertainty data to minimize a deviation between an actual drilling trajectory and a planned drilling trajectory, according to an embodiment.

FIG. 8 illustrates an example flowchart of a process for using uncertainty data to minimize a deviation between an actual drilling trajectory and a planned drilling trajectory. The blocks of FIG. 8 may be implemented in the environment of FIG. 3, for example, and are described using reference numbers of elements depicted in FIG. 3. The flowchart illustrates the architecture, functionality, and operation of possible implementations of systems, methods, and computer program products according to various embodiments of the present disclosure.

As shown in FIG. 8, process 800 may include a drilling trajectory plan (block 805). For example, the steering response and uncertainty planning device 330 may receive a drilling trajectory plan associated with a directional drilling project (e.g., for drilling a wellbore). An example of the drilling trajectory plan is described above with respect to FIG. 2.

Process 800 may also include dividing the planned trajectory into sections (block 810). For example, the steering response and uncertainty planning device 330 may divide the planned trajectory into sections. In some embodiments, the s330 may divide the planned trajectory into sections based on receiving (e.g., from an operator or planner) user inputs and selections that define the sections. Additionally, or alternatively, the steering response and uncertainty planning device 330 may automatically divide the planned trajectory into sections based on prior similar drilling projects. In some embodiments, automatically generated sections may be confirmed and/or manually adjusted via user inputs and selections. In some embodiments, each section may include a drilling angle or curve. That is, as the drilling angle or curve changes along the planned trajectory, a different section may be defined.

Process 800 may further include identifying the tool face orientation to drill in an intended trajectory for a section (block 815). For example, the steering response and uncertainty planning device 330 may identify the tool face orientation that should be set in order to drill in the intended trajectory for a section. As described above, the tool face orientation or angle may match the drilling trajectory angle, or the tool face orientation may differ based on a predetermined offset.

Process 800 may also include identifying an uncertainty associated with the tool face orientation (block 820). For example, the steering response and uncertainty planning device 330 may determine the uncertainty associated with the tool face orientation based on a data structure or repository storing uncertainties at different tool face orientations (e.g., the data structure or repository described above with respect to process block 740 of FIG. 7). Additionally, or alternatively, an operator may use a steering response map (e.g., a heatmap ellipse) to identify the uncertainty at the tool face orientation.

Process 800 may further include determining a drilling plan for the section based on the uncertainty (block 825). For example, the steering response and uncertainty planning device 330 may determine a drilling plan for the section based on the uncertainty. In some embodiments, the steering response and uncertainty planning device 330 may automatically determine a drilling plan based on a set of criteria that identifies a drilling plan based on the uncertainty. Additionally, or alternatively, the steering response and uncertainty planning device 330 may receive, via user input, a drilling plan from an operator or planner in which the plan may be determined using the uncertainty data. In some embodiments, the drilling plan may identify an equipment operating speed, operating torque level, build rate, turn rate, trajectory monitoring rates, etc. As an illustrative example, for a tool face orientation having relatively low uncertainty value, the operating speed, operating torque level, build rate, and/or turn rate may be relatively higher than for a tool face orientation having a relatively high uncertainty value.

In general, when uncertainty is relatively lower, equipment may be set to drill at higher speeds and torque, with less frequent trajectory checks, as it is less likely that these higher speeds and torque will cause the actual drilling trajectory to deviate from the planned trajectory. Similarly, when uncertainty is relatively higher, equipment may be set to drill at lower speeds and torque, with more frequent trajectory checks, as it is more likely that the actual drilling trajectory may deviate from the planned trajectory.

Process 800 may also include outputting the drilling plan for execution (block 860). For example, the steering response and uncertainty planning device 330 may output the drilling plan for execution (e.g., to the equipment control device 310). Alternatively, in some embodiments, an operator may output the drilling plan for execution to the equipment control device 310 without involving the steering response and uncertainty planning device 330. In any event, the equipment control device 310 may execute the drilling plan to cause the drilling equipment to operate in accordance with the drilling plan (e.g., at the planned speed, torque, build rate, turn rate, etc.).

Process 800 may further include monitoring real-time drilling trajectory (block 835). For example, the steering response and uncertainty planning device 330 may monitor the real-time drilling trajectory based on information received from the drilling trajectory tracking device 320. More specifically, the steering response and uncertainty planning device 330 may monitor a deviation between the real-time trajectory and the planned trajectory. In some embodiments, the steering response and uncertainty planning device 330 may check or monitor the drilling trajectory at a particular frequency or rate in which the monitoring rate may be defined by the drilling plan (e.g., relatively higher monitoring rates may apply when uncertainty is relatively higher).

Process 800 may also include determining whether a deviation between the real-time trajectory and the planned trajectory is within a threshold level (block at 840). For example, the steering response and uncertainty planning device 330 may determine whether the real-time trajectory and the planned trajectory is within a threshold level based on monitoring the real-time trajectory. In some embodiments, the threshold level may be configurable and may be a trade-off between minimizing the deviation between the real-time and planned trajectories, and the number of adjustments made to the drilling operations.

If, for example, the deviation is not within a threshold level (block 840—NO), process 800 may further include adjusting the drilling plan (block 845). For example, the steering response and uncertainty planning device 330 may adjust the drilling plan by modifying the tool face orientation to alter the real-time trajectory towards the planned trajectory. Further, the adjusted drilling plan may adjust (e.g., lower) the speed, torque, build rate, turn rate, monitoring rate, etc. Process 800 may return to block 830 whereby the adjust drilling plan may be output for execution, and the real-time drilling trajectory is monitored for deviation against the planned trajectory (block 835). Further adjustments may be made if the deviation is not within the threshold level.

If, on the other hand, the deviation is within the threshold level (block 840—YES), process 800 may include determining whether all sections have been completed (block 850). For example, the steering response and uncertainty planning device 330 may determine whether the all sections of the drilling project have been completed based on drilling analytics and status information received from the drilling trajectory tracking device 320.

If, for example, all sections have not been completed, and additional sections are to be drilled (block 850—NO), process 800 may return to block 815, whereby a drilling plan for the next section may be determined and executed based on a tool face direction and uncertainty. If, on the other hand, all sections have been completed (block 850—YES), no further action may be taken and process 800 may end.

In accordance with processes 700 and 800, steering response uncertainty data may be considered when planning a drilling project in advance and/or adjusting drilling operations in real time, thereby minimizing the deviation between a planned drilling trajectory and an actual drilling trajectory. Also, at the conclusion of a directional drilling project, the steering response uncertainty data may be used to analyze different features of a well design and the impact on the steering responses such as the impact on steering tool type, (e.g., motor, RSS, etc.), the drill bit, BHA, stabilizers and drill collars positions, different formation zones responses, drilling parameters used, inclination and trajectory, wear rate of different tools, shock and vibration, and/or other impacts.

As described herein, aspects of the present disclosure may be used to graphically present the uncertainty of steering responses at different tool face directions. In some embodiments, the uncertainty data may be used to improve directional drilling planning and real-time drilling operations such that actual drilling trajectory more closely matches a planned or intended drilling trajectory. Also, at the conclusion of a directional drilling project, aspects of the present disclosure may be used to analyze different features of a well's design and how those features affect steering responses (e.g., on the steering tool and motor, the drill bit, stabilizer and drill collar positions, formation zone response, drilling parameters used, inclination and trajectory, wear rate, shock and vibration, etc.).

Figure 9:
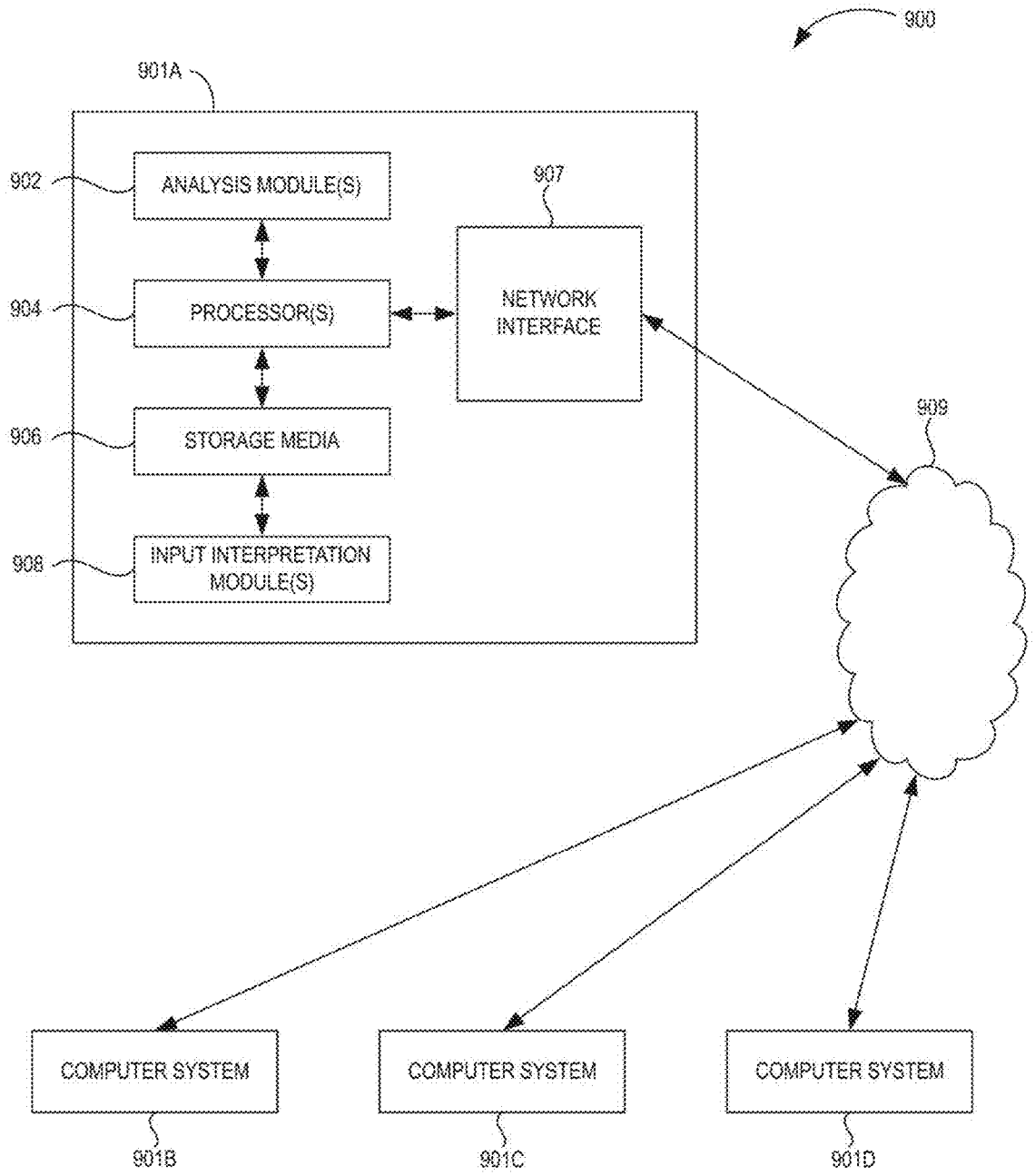
FIG. 9 illustrates a schematic view of a computing system, according to an embodiment.

In some embodiments, the methods of the present disclosure may be executed by a computing system. FIG. 9 illustrates an example of such a computing system 900, in accordance with some embodiments. The computing system 900 may include a computer or computer system 901A, which may be an individual computer system 901A or an arrangement of distributed computer systems. The computer system 901A includes one or more analysis modules 902 that are configured to perform various tasks according to some embodiments, such as one or more methods disclosed herein. To perform these various tasks, the analysis module 902 executes independently, or in coordination with, one or more processors 904, which is (or are) connected to one or more storage media 906. The processor(s) 904 is (or are) also connected to a network interface 907 to allow the computer system 901A to communicate over a data network 909 with one or more additional computer systems and/or computing systems, such as 901B, 901C, and/or 901D (note that computer systems 901B, 901C and/or 901D may or may not share the same architecture as computer system 901A, and may be located in different physical locations, e.g., computer systems 901A and 901B may be located in a processing facility, while in communication with one or more computer systems such as 901C and/or 901D that are located in one or more data centers, and/or located in varying countries on different continents).

A processor may include a microprocessor, microcontroller, processor module or subsystem, programmable integrated circuit, programmable gate array, or another control or computing device.

The storage media 906 may be implemented as one or more computer-readable or machine-readable storage media. Note that while in the example embodiment of FIG. 9 storage media 906 is depicted as within computer system 901A, in some embodiments, storage media 906 may be distributed within and/or across multiple internal and/or external enclosures of computing system 901A and/or additional computing systems. Storage media 906 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 900 contains one or more steering response uncertainty determination module(s) 908. In the example of computing system 900, computer system 901A includes the steering response uncertainty determination module(s) 908. In some embodiments, a single steering response uncertainty determination module 908 may be used to perform some aspects of one or more embodiments of the methods disclosed herein. In other embodiments, a plurality of steering response uncertainty determination modules 908 may be used to perform some aspects of methods herein.

It should be appreciated that computing system 900 is merely one example of a computing system, and that computing system 900 may have more or fewer components than shown, may combine additional components not depicted in the example embodiment of FIG. 9, and/or computing system 900 may have a different configuration or arrangement of the components depicted in FIG. 9. The various components shown in FIG. 9 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 900, FIG. 9), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosed embodiments and various embodiments with various modifications as are suited to the particular use contemplated.

What is claimed is:

1. A computer-implemented method comprising:

receiving a steering command identifying a tool face orientation, wherein the steering command is expected to produce an intended steering response of an intended drilling trajectory;

receiving an actual steering response result of the steering command, wherein the actual steering response result identifies an actual drilling trajectory;

storing a dataset comparing the actual steering response result in relation to the intended steering response;

determining an uncertainty level of the tool face orientation based on the stored dataset; and outputting a visual representation of steering response with the uncertainty level.

2. The method of claim 1, wherein the visual representation comprises at least one of:

a steering response ellipse having a heatmap; and a steering response ellipse with an uncertainty band.

3. The method of claim 1, wherein the uncertainty level represents a level of confidence that the actual steering response result matches the intended steering response.

4. The method of claim 1, wherein the steering response command further identifies a build rate and a turn rate, wherein the uncertainty level is further based on the build rate and the turn rate.

5. The method of claim 1, further comprising storing a plurality of datasets, each of the plurality of datasets being associated with respective tool face orientations and comparing a plurality of respective actual steering response results in relation to a respective plurality of intended steering responses.

6. The method of claim 5, wherein the determining the uncertainty level comprises determining the uncertainty level based on a quantity of the plurality of datasets that are associated with the tool face orientation and a consistency of deviations between the plurality of respective actual steering response results in relation to a respective plurality of intended steering responses within the plurality of datasets that are associated with the tool face orientation.

7. The method of claim 1, further comprising receiving, via user input, or automatically generating a drilling plan based on the uncertainly level.

8. The method of claim 1, further comprising planning equipment operations in advance or adjusting the equipment operations in real-time based on the uncertainty level.

9. The method of claim 8, wherein the equipment operations include at least one of:

operating speed;

operating torque;

build rate;

turn rate; and trajectory monitoring rate.

10. A computing system, comprising:

one or more processors; and a memory system comprising one or more non-transitory computer-readable media storing instructions that, when executed by at least one of the one or more processors, cause the computing system to perform operations, the operations comprising:

receiving a drilling trajectory plan identifying a planned drilling trajectory;

determining a tool face orientation for drilling along a portion of the planned drilling trajectory by drilling equipment;

identifying an uncertainty level associated with the tool face orientation based on steering response uncertainty data stored in a repository;

determining a drilling plan for drilling along the portion based on the uncertainty level; and outputting the drilling plan for executing the drilling plan by the drilling equipment.

11. The computing system of claim 10, wherein the drilling plan comprises at least one of:

operating speed;

operating torque;

build rate;

turn rate; and trajectory monitoring rate.

12. The computing system of claim 10, further comprising:

monitoring a real-time trajectory after outputting the drilling plan for execution;

determining that a deviation between the real-time trajectory and the planned drilling trajectory exceed a threshold;

adjusting the drilling plan based on the determining that the deviation exceeds the threshold, wherein the adjusting the drilling plan comprises identifying an updated tool face orientation and identifying an uncertainty level associated with the updated tool face orientation; and outputting the adjusted drilling plan for execution.

13. The computing system of claim 10, further comprising outputting a visual representation of the uncertainty level.

14. The computing system of claim 13, wherein the visual representation comprises at least one of:

a steering response ellipse having a heatmap; and a steering response ellipse with an uncertainty band.

15. The computing system of claim 13, wherein the uncertainty level represents a level of confidence that an actual steering response matches an intended steering response.

16. A non-transitory computer-readable medium storing instructions that, when executed by one or more processors of a computing system, cause the computing system to perform operations, the operations comprising:

determining a respective plurality of uncertainty levels of respective tool face orientations based on deviations between expected drilling trajectories and actual drilling trajectories;

storing the respective plurality of uncertainty levels in a repository; and outputting a visual representation of the respective plurality of uncertainty levels.

17. The computer-readable medium of claim 16, wherein the visual representation comprises at least one of:

a steering response ellipse having a heatmap; and a steering response ellipse with an uncertainty band.

18. The computer-readable medium of claim 16, where the operations further comprise:

receiving a drilling trajectory plan identifying a planned drilling trajectory;

determining a tool face orientation for drilling along a portion of the planned drilling trajectory;

identifying a particular uncertainty level, of the stored respective plurality of uncertainty levels, associated with the tool face orientation;

determining a drilling plan for drilling along the portion based on the particular uncertainty level; and outputting the drilling plan for executing the drilling plan.

19. The computer-readable medium of claim 18, wherein the drilling plan comprises at least one of:

operating speed;

operating torque;

build rate;

turn rate; and trajectory monitoring rate.

20. The computer-readable medium of claim 16, wherein each of the plurality of the respective uncertainty levels represent a level of confidence that an actual steering response matches an intended steering response.

* * * * *